US007703160B2

(12) United States Patent
Wang

(10) Patent No.: US 7,703,160 B2
(45) Date of Patent: Apr. 27, 2010

(54) INFLATABLE MATTRESS

(76) Inventor: Cheng-Chung Wang, 9F, No. 24, Songjhih Rd., Sinyi Dist., Taipei (TW)

( * ) Notice: Subject to any disclaimer, the term of this patent is extended or adjusted under 35 U.S.C. 154(b) by 0 days.

(21) Appl. No.: 12/323,699

(22) Filed: Nov. 26, 2008

(65) Prior Publication Data

US 2009/0077753 A1 Mar. 26, 2009

Related U.S. Application Data

(63) Continuation of application No. 11/790,115, filed on Apr. 24, 2007, now abandoned.

(30) Foreign Application Priority Data

Apr. 25, 2006 (CN) ..... 2006 2 0058281 U

(51) Int. Cl.
*A47C 27/08* (2006.01)

(52) U.S. Cl. ..... 5/706; 5/723; 5/691

(58) Field of Classification Search ..... 5/706, 5/723, 737–738, 691; 24/572.1
See application file for complete search history.

(56) References Cited

U.S. PATENT DOCUMENTS 5,428,852 A * 7/1995 Tenuta et al. ..... 5/690
6,954,957 B2 * 10/2005 Metzger et al. ..... 5/706

* cited by examiner

*Primary Examiner*—Fredrick Conley
(74) *Attorney, Agent, or Firm*—Hershkovitz & Associates, LLC; Abraham Hershkovitz

(57) ABSTRACT

An inflatable mattress has a body and a coverlet. The body is hollow, is inflatable and has a top, a sidewall and at least one first engaging member attached to the sidewall of the body. The coverlet is mounted detachably on and covers the body and has at least one second engaging member attached to the coverlet and corresponding respectively to and detachably engaged respectively with the at least one first engaging member on the body. The coverlet is mounted tightly on the body and would not be shifted by persons' movement on the inflatable mattress.

4 Claims, 15 Drawing Sheets

INFLATABLE MATTRESS

The present invention is a continuation application claiming the benefit of the U.S. patent application Ser. No. 11/790,115 filed on Apr. 24, 2007 now abandoned.

BACKGROUND OF THE INVENTION

1. Field of the Invention

The present invention relates to a mattress, and more particularly to an inflatable mattress that has a body and a coverlet tightly and flatly mounted detachably on the body without any wrinkles so that the coverlet on the body looks tidy and would not be shifted inadvertently by persons' movement on the inflatable mattress.

2. Description of Related Art

Inflatable mattresses are used generally in travels and camping because of their compressibility and portability.

However, people lying on the inflatable mattress feel less comfortable than they feel when lying on a traditional bed because of no sufficient soft cushion such as cotton fill put in the inflatable mattress.

U.S. Pat. No. 7,007,329 disclosed a conventional inflatable mattress with a pillow top. The pillow top is mounted on a top of a mattress body. However, the pillow top has no cushion function so that people lying on the pillow top on the mattress body would still feel more uncomfortable as compared with conventional beds. Furthermore, the conventional inflatable mattress has a second fastener portion attached to the edge weld of the inflatable mattress. The attachment prevents the pillow top to be secured tightly to the surface of the inflatable mattress and would appear to be "loose" across the surface of the inflatable mattress.

To overcome the shortcomings, the present invention provides an inflatable mattress with a coverlet to mitigate or obviate the aforementioned problems.

SUMMARY OF THE INVENTION

The main objective of the invention is to provide an inflatable mattress that has a body and a coverlet tightly and flatly mounted detachably on the body without any wrinkles so that the coverlet on the body looks tidy and would not be shifted inadvertently by persons' movement on the inflatable mattress.

An inflatable mattress in accordance with the present invention comprises a body and a coverlet. The body is hollow, is inflatable and has at least one first engaging member attached to the body. The coverlet is mounted detachably on and covers the body and has a top cushion and at least one second engaging member attached to the coverlet and corresponding respectively to and detachably engaged respectively with the at least one first engaging member on the body.

Other objectives, advantages and novel features of the invention will become more apparent from the following detailed description when taken in conjunction with the accompanying drawings.

DETAILED DESCRIPTION OF THE PREFERRED EMBODIMENT

Figure 1A:
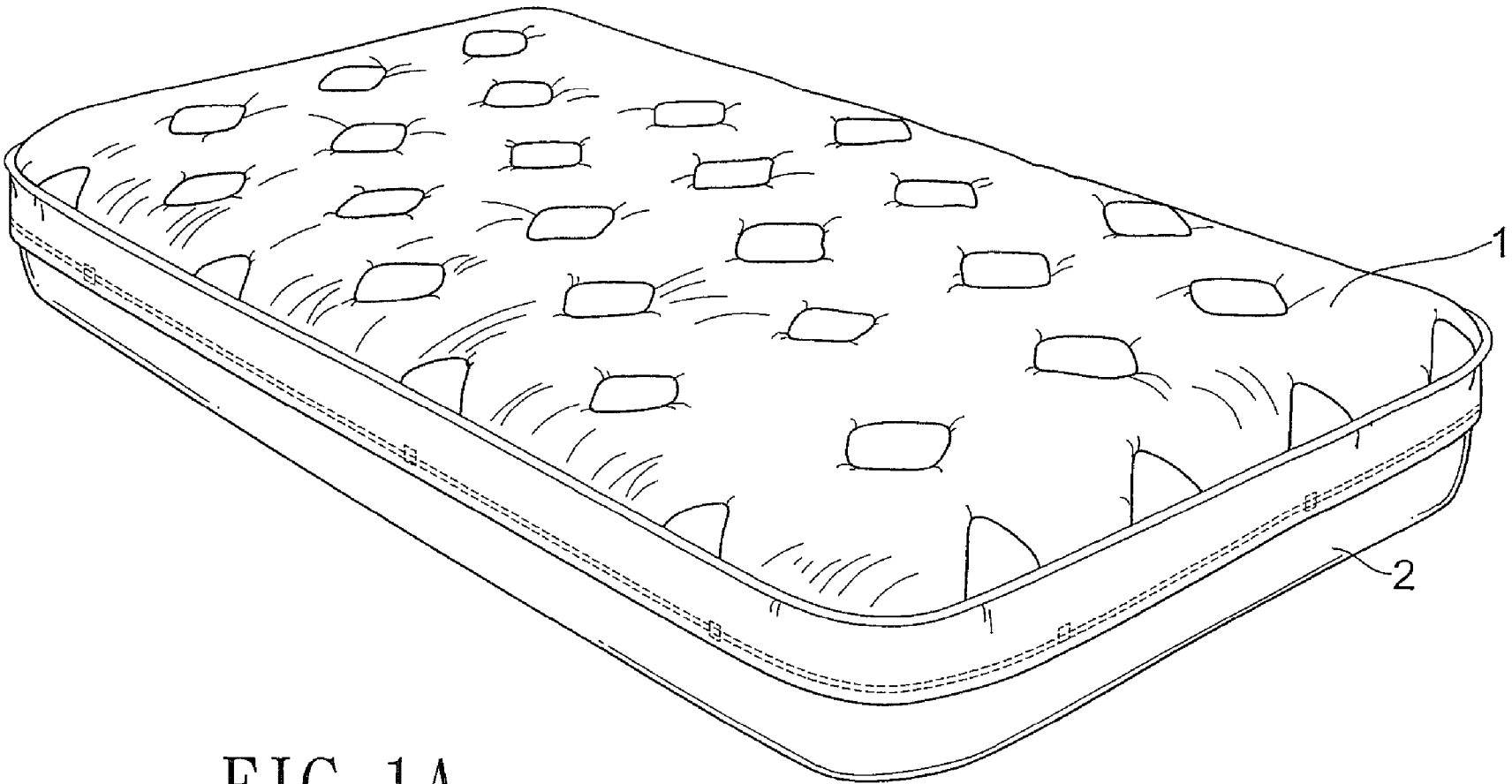
FIG. 1A is a perspective view of a first embodiment of an inflatable mattress with a coverlet in accordance with the present invention.
Figure 1B:
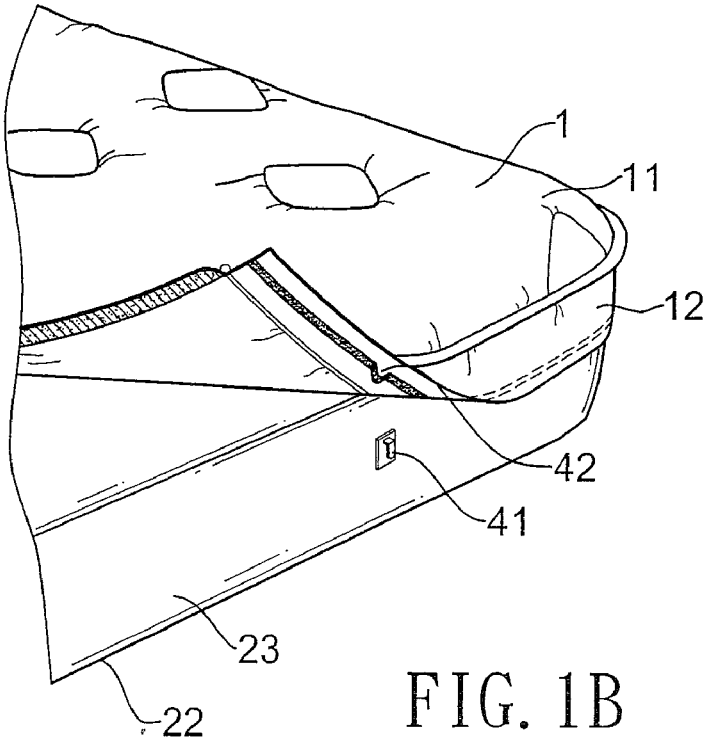
FIG. 1B is a partially enlarged cross sectional perspective view of the inflatable mattress in FIG. 1A with the body having hooks and the coverlet having loops.
Figure 1C:
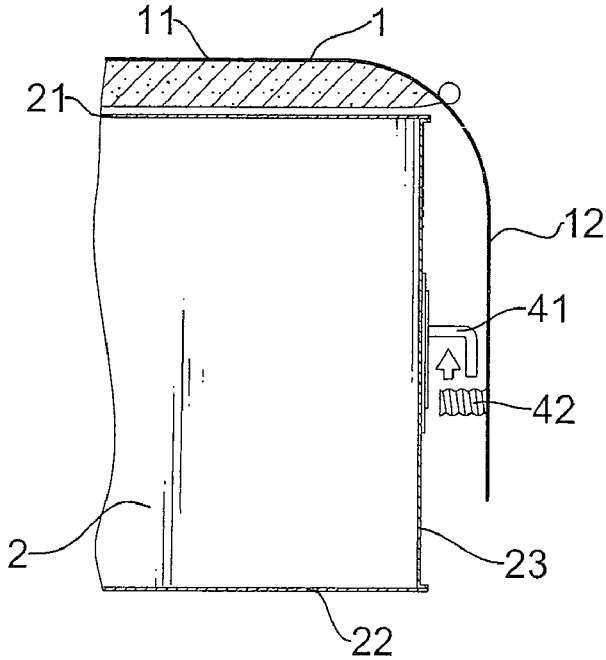
FIG. 1C is an operational enlarged side view in partial section of the inflatable mattress in FIG. 1B showing one loop to be mounted around one hook.

With reference to FIGS. 1A to 1C, a first embodiment of an inflatable mattress in accordance with the present invention comprises a body (2) and a coverlet (1).

The body (2) is hollow, is inflatable and has a top (21), a bottom (22), a sidewall (23) and at least one first engaging member.

The sidewall (23) is annular, may be rectangular and have four side surfaces and four corners.

The at least one first engaging member, is attached to the sidewall (23) of the body (2) at a distance from the top of the body (2) and is at least one hook (41) mounted on the sidewall (23). A preferred embodiment of the body (2) has four sets of at least one hook (41) mounted respectively on the four side surfaces of the sidewall (23).

The coverlet (1) is mounted detachably on and covers the body (2) and has a top cushion (11), a skirt (12) and at least one second engaging member.

The top cushion (11) is soft and resilient, is located above on the top of the body (2), corresponds to the top (21) of the body (2) and has an outer edge, an internal chamber and a fill. The internal chamber is defined in the top cushion (11). The fill is made of fiber such as cotton or wool and is filled in the internal chamber so that the cushion (11) may provide a soft and comfortable feel to persons lying on the coverlet (1).

The skirt (12) is annular, extends out from the outer edge of the top cushion (11), corresponds to the sidewall (23) of the body (2) and has an outer edge.

The at least one second engaging member is attached to the skirt (12) of the coverlet (1) and corresponds respectively to and is detachably engaged respectively with the at least one first engaging member. In some aspects, a distance from the at least one second engaging member to the outer edge of the top cushion (11) may be shorter than the distance from the at least one first engaging member to the top of the body (2) so that the coverlet (1) mounted on the body (2) is stretched tightly and flatly. The skirt (12) is pulled and the coverlet (1) is stretched tightly across the top (21) and the sidewall (23) of the body (2) when the at least one second engaging member is engaged respectively with the at least one first engaging member on the sidewall (23) of the body (2). Therefore, the coverlet (1) is mounted tightly and flatly to the body (2) without any wrinkles. The at least one second engaging member is at least one loop (42) mounted on the skirt (12), detachably mounted respectively around and hooked respectively by the at least one hook (41) on the sidewall (23) of the body (2) so that the coverlet (1) would be mounted detachably on the body (2). A preferred embodiment of the coverlet (1) has four sets of at least one loop (42) mounted on the skirt (12), corresponding respectively to the sets of the at least one hook (41). The at least one loop (42) of each set is mounted respectively around and hooked respectively by the at least one hook (41) of a corresponding set.

Figure 2:
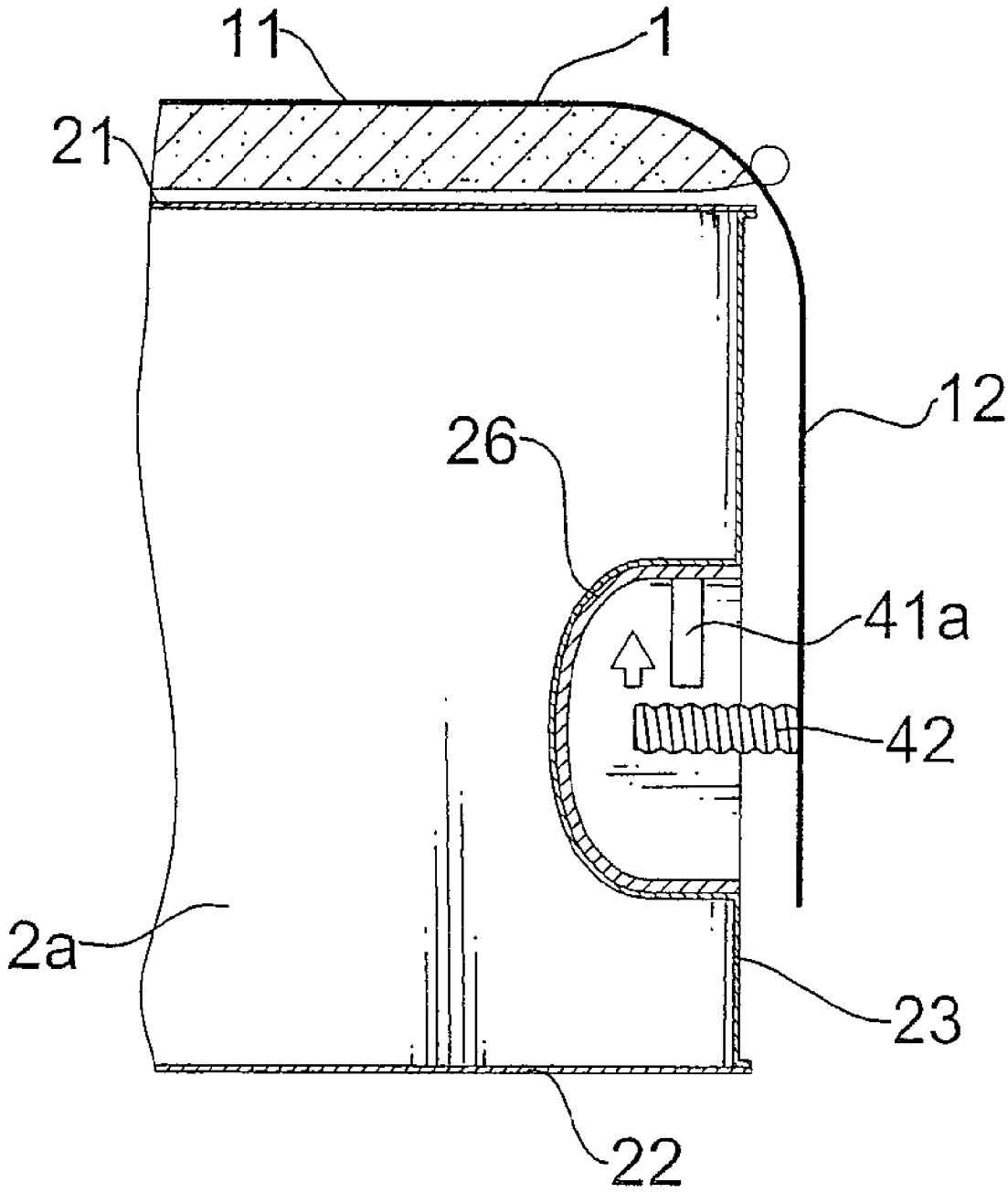
FIG. 2 is an operational enlarged side view in partial section of a second embodiment of the inflatable mattress in accordance with the present invention with the body having recesses and hooks in the recesses and the coverlet having loops.
Figure 3A:
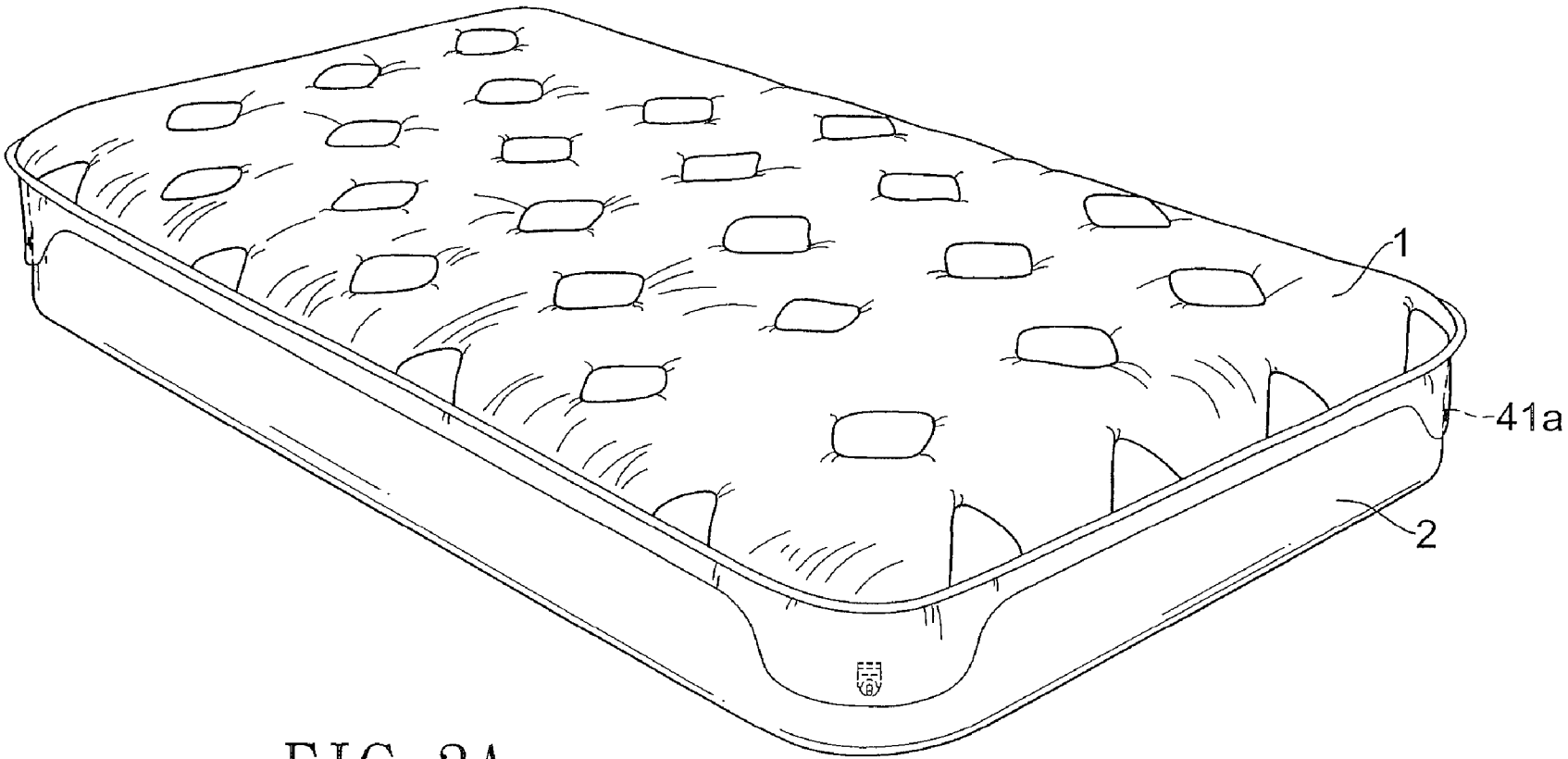
FIG. 3A is a perspective view of a third embodiment of the inflatable mattress in accordance with the present invention.
Figure 3B:
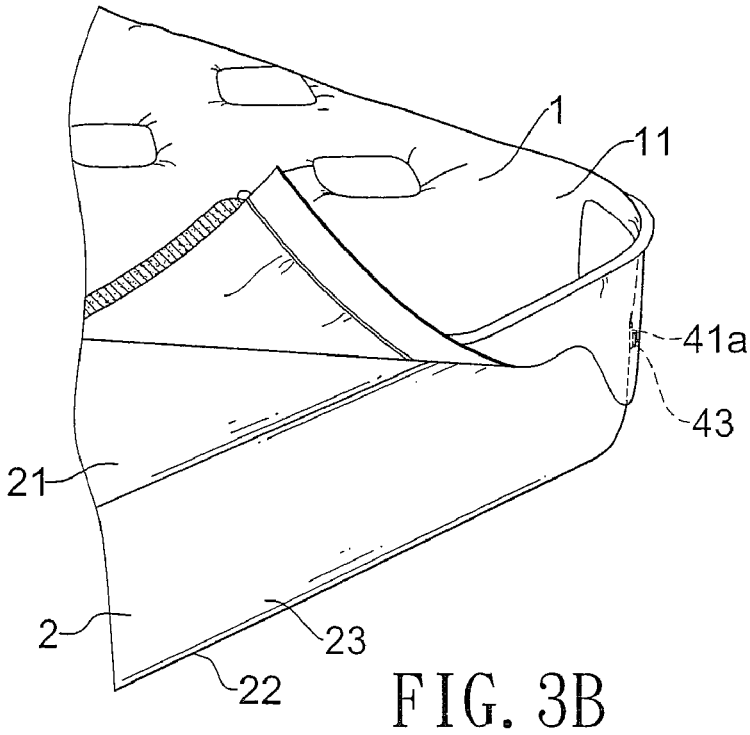
FIG. 3B is a partially enlarged cross sectional perspective view of the inflatable mattress in FIG. 3A with the body having hooks and the coverlet having fasteners being rigid.
Figure 3C:
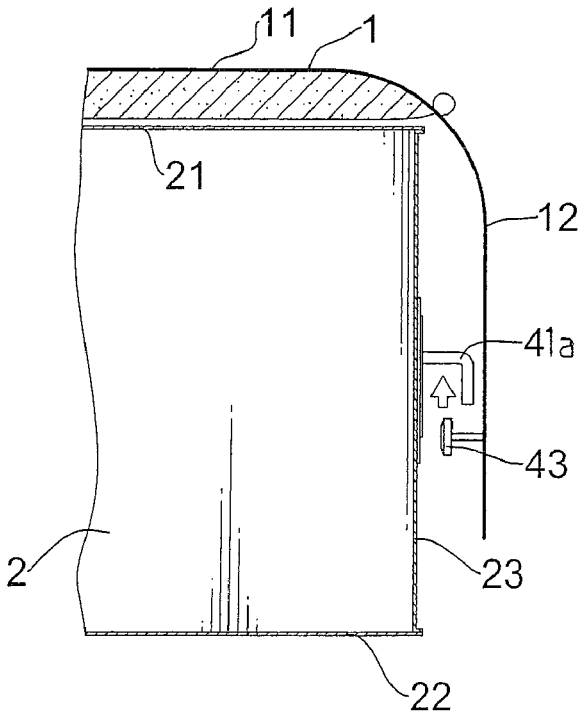
FIG. 3C is an operational enlarged side view in partial section of the inflatable mattress in FIG. 3B showing one bolt-shaped fastener to be engaged with a corresponding fork-shaped hook.
Figure 3D:
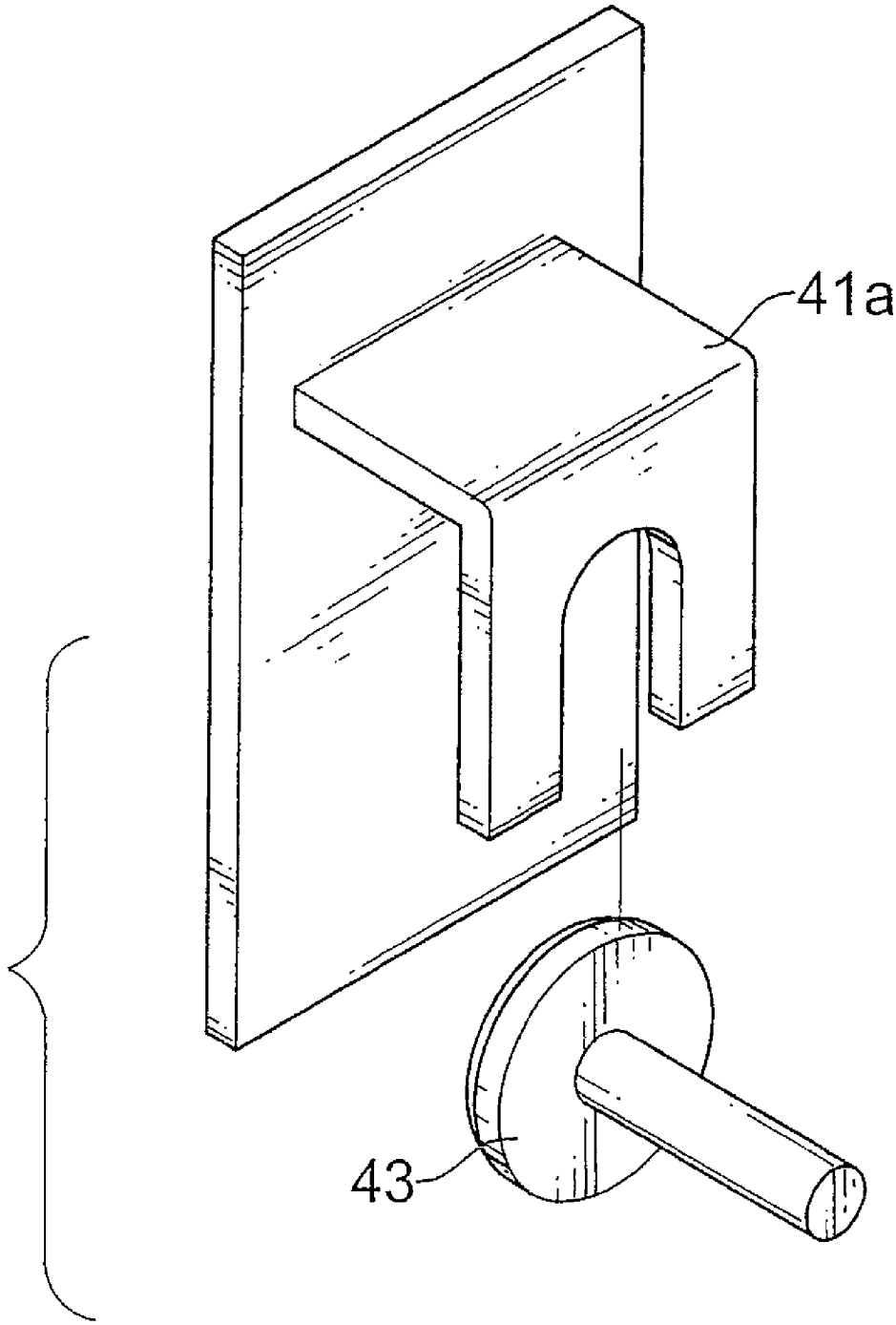
FIG. 3D is an exploded perspective view of the bolt-shaped fastener and the fork-shaped hook of the inflatable mattress in FIG. 3D.

With reference to FIG. 2, a second embodiment of the inflatable mattress in accordance with the present invention is similar to the first embodiment however has the body (2*a*) further comprising at least one recess members (26). The at least one recess member (26) is hollow, is mounted in the sidewall (23) of the body (2*a*), correspond respectively to the at least one first engaging member and each recess member (26) has an inner surface. Each first engaging member is a hook (41) and is mounted on the inner surface in a corresponding recess member (26). The at least one second engaging member is at least one loop (42) extending respectively in the at least one recess member and detachably mounted respectively around and hooked respectively by the at least one hook (41).

With reference to FIGS. 3A to 3D, a third embodiment of the inflatable mattress in accordance with the present invention is similar to the first embodiment yet has the at least one first engaging member being four fork-shaped hooks (41*a*). The fork-shaped hooks (41*a*) are located respectively on the four corners of the body (2). Each fork-shaped hook (41*a*) has a notch defined in the fork-shaped hook (41*a*). The coverlet (1) has the at least one second engaging members being four bolt-shaped fasteners (43). The four bolt-shaped fasteners (43) are detachably hooked respectively by the fork-shaped hooks (41*a*). Each bolt-shaped fastener (43) has a shaft and an enlarged head. The shaft extends through the notch in a corresponding fork-shaped hook (41*a*) and has a distal end. The enlarged head is formed on the distal end of the shaft and is hooked by the corresponding fork-shaped hook (41*a*).

Figure 4A:
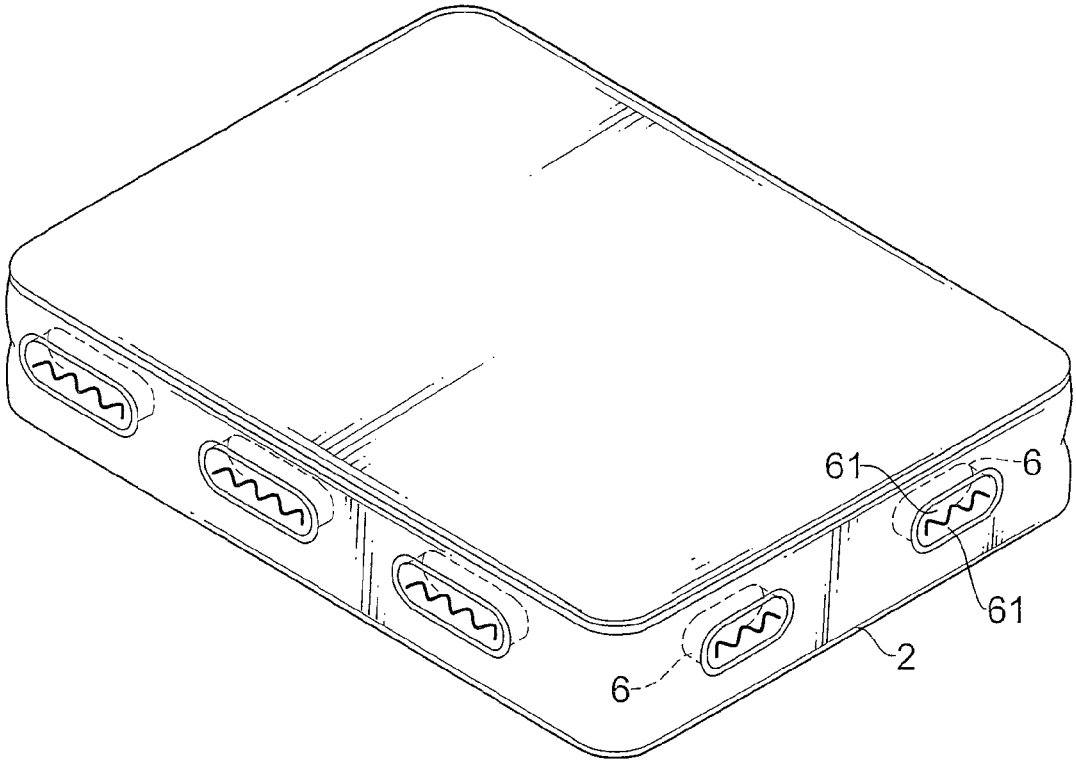
FIG. 4A is a perspective view of a fourth embodiment of the inflatable mattress in accordance with present invention with the coverlet detached.
Figure 4B:
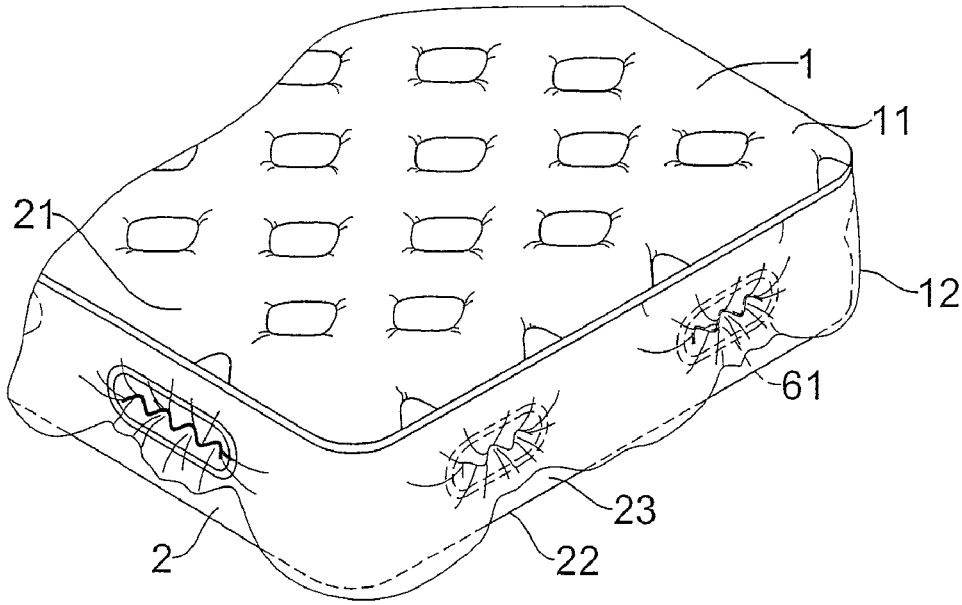
FIG. 4B is a partially exploded perspective view of the inflatable mattress in FIG. 4A with the body having recess members and the coverlet having a skirt.
Figure 4C:
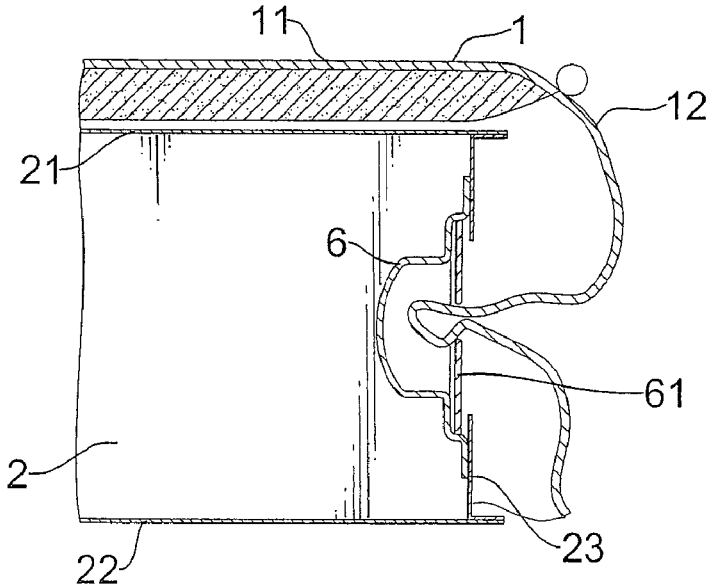
FIG. 4C is an operational enlarged side view in partial section of the inflatable mattress in FIG. 4B showing the skirt stuffed in the recess member.

With reference to FIGS. 4A to 4C, a fourth embodiment of the inflatable mattress in accordance with the present invention is similar to the first embodiment however has the at least one first engaging member being at least one recess member (6). Each recess member (6) is hollow and has an opening and two opposite clipping members (61). The opening has an inner edge. The two clipping members (61) are flexible and are mounted on the inner edge in the opening. Each clipping member (61) has a saw-tooth-shaped clipping edge. The saw-tooth-shaped clipping edges of the clipping members (61) face each other. The at least one second engaging member of the coverlet (1) is at least one part of the skirt (12) of the coverlet (1). The at least one part of the skirt (12) corresponds respectively to and is stuffed respectively in the at least one recess member (6). Each part of the skirt (12) is clipped and bitten by the saw-tooth-shaped clipping edges of the clipping members (61) on a corresponding recess member (61).

Figure 5A:
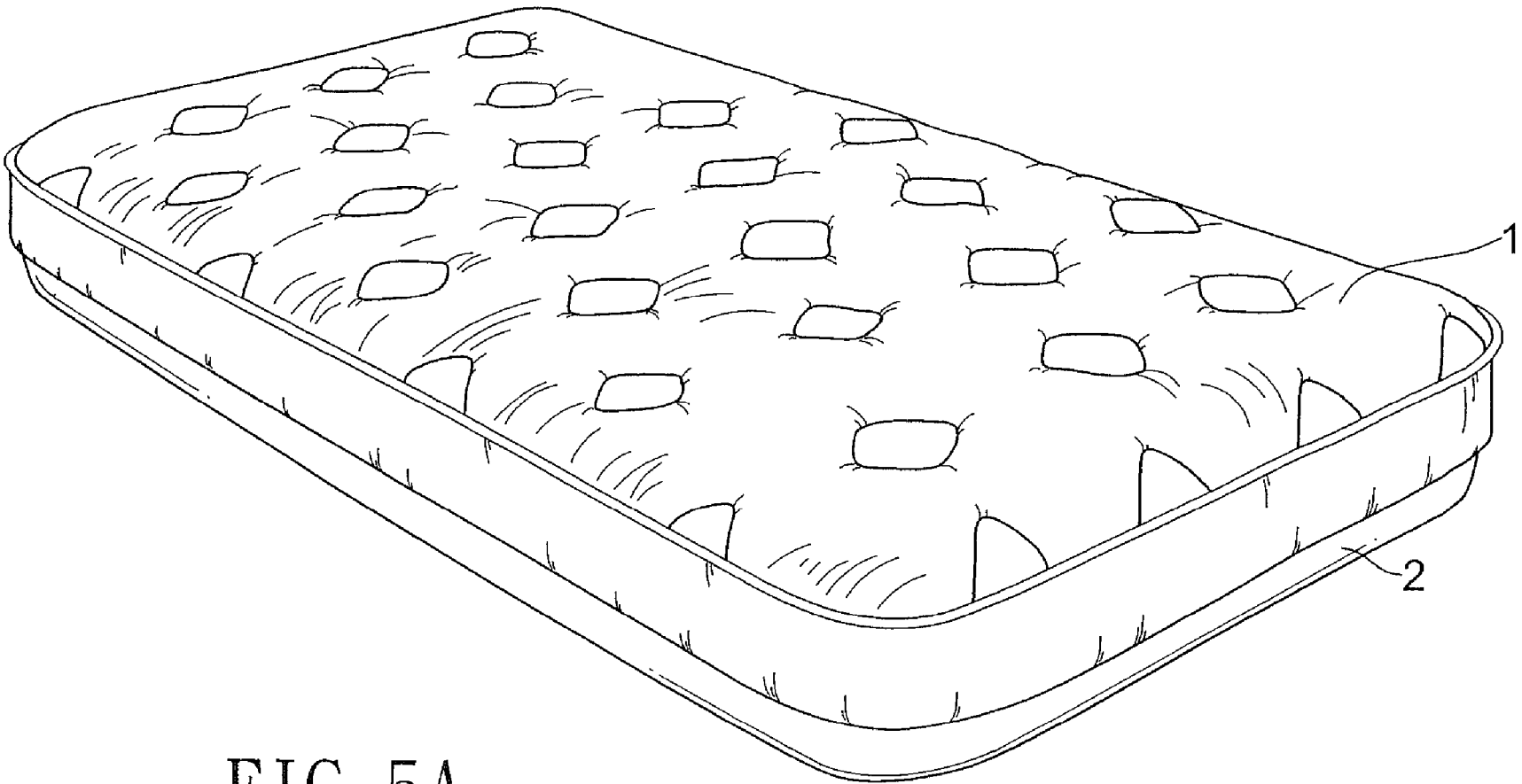
FIG. 5A is a perspective view of a fifth embodiment of the inflatable mattress in accordance with the present invention.
Figure 5B:
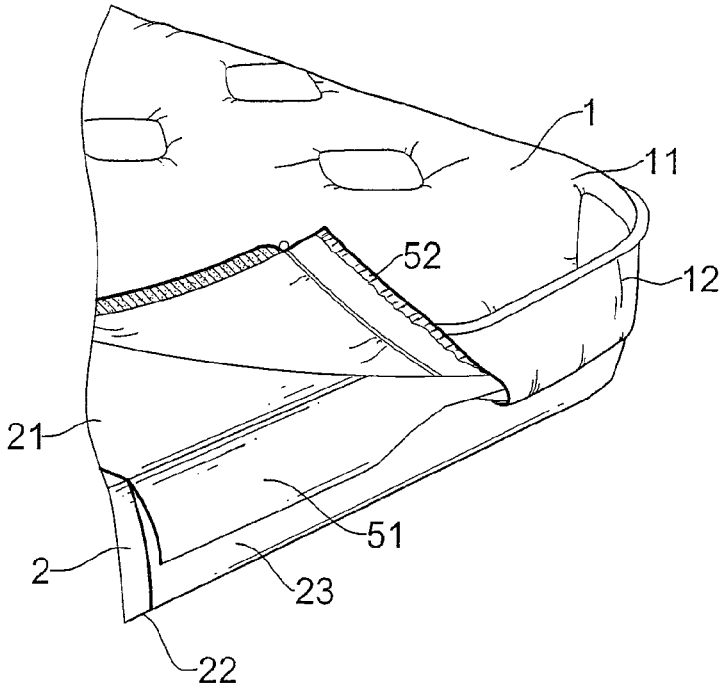
FIG. 5B is a partially exploded cross sectional perspective view of the inflatable mattress in FIG. 5A with the body having a pocket and the coverlet having the skirt including the thickened hem.
Figure 5C:
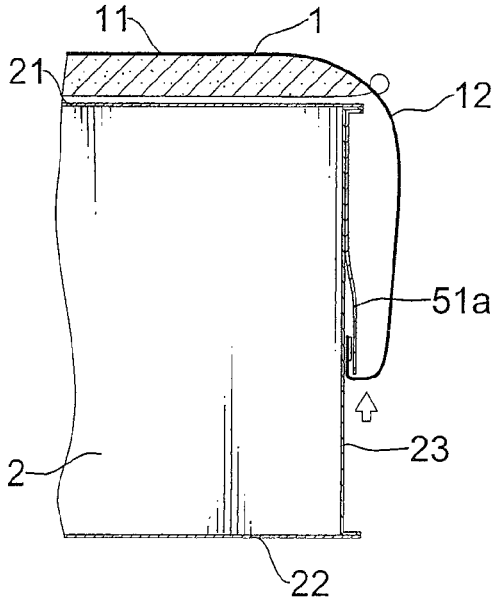
FIG. 5C is an operational enlarged side view in partial section of the inflatable mattress in FIG. 5C showing the thickened hem on the skirt stuffed in the pocket on the body.

With reference to FIGS. 5A to 5C, a fifth embodiment of the inflatable mattress in accordance with the present invention is similar to the first embodiment however has the at least one first engaging member of the body (2) being a pocket (51). The pocket (51) is annular and hollow, is mounted around the sidewall (23) at a distance from the top (21) of the body (2) and has a lower opening. The at least one second engaging member (52) is a thickened hem (52) being annular, attached to the outer edge of the skirt (12) of the coverlet (1) and stuffed detachably in the pocket (51) through the lower opening.

Figure 6A:
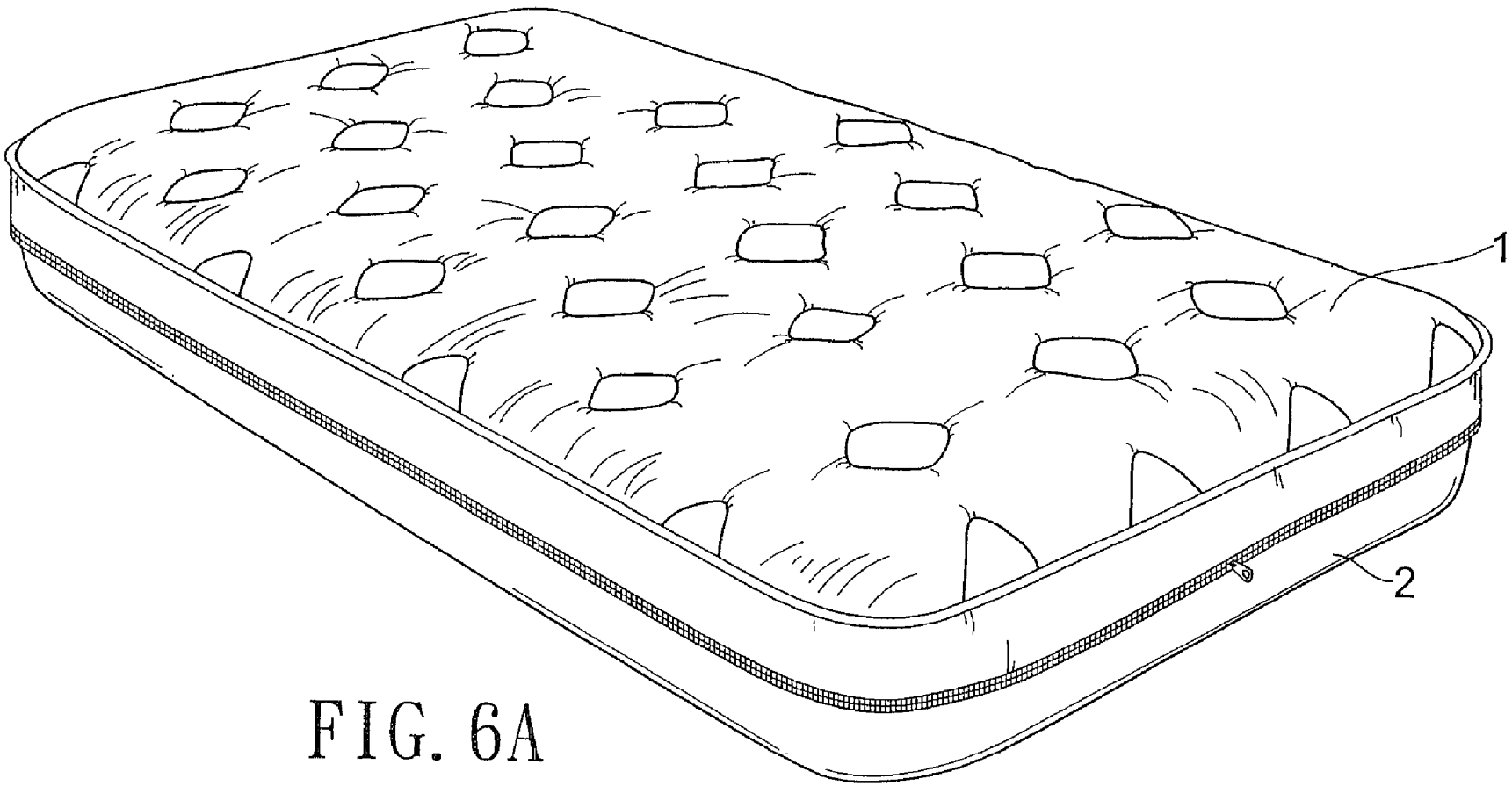
FIG. 6A is perspective view of a sixth embodiment of the inflatable mattress in accordance with the present invention.
Figure 6B:
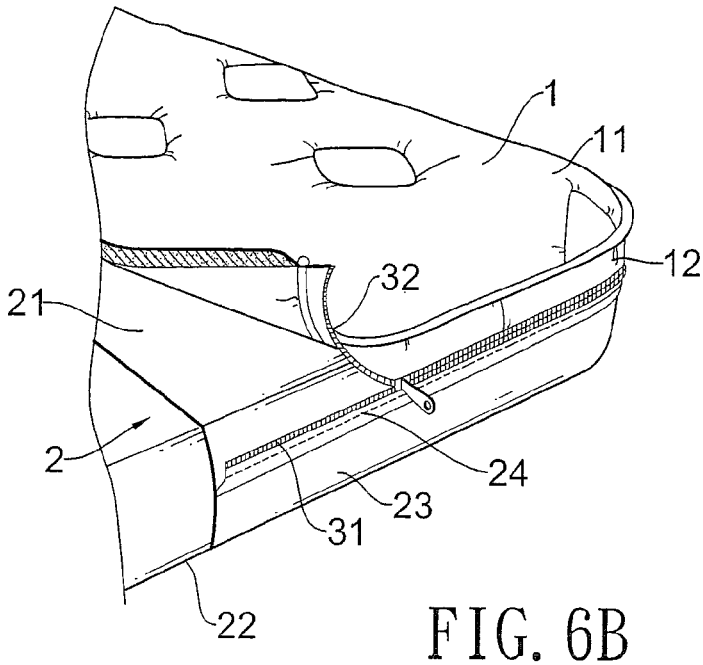
FIG. 6B is a partially enlarged perspective view of the inflatable mattress in FIG. 6A with the zipper mounted between the body and the coverlet.
Figure 6C:
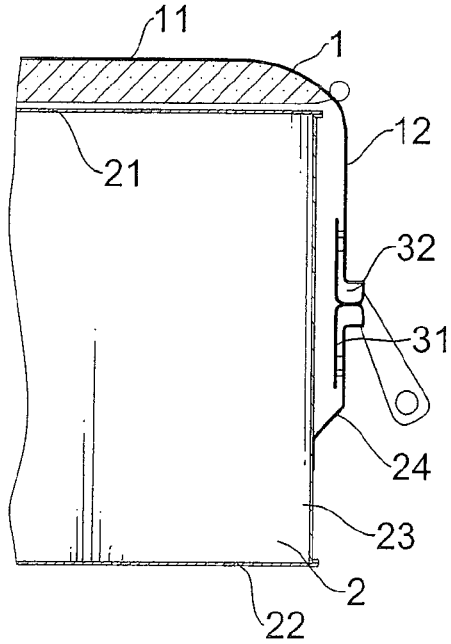
FIG. 6C is a side view in partial section of the inflatable mattress in FIG. 6B with the slider on the zipper sliding the engage the zipper halves with each other to mount the coverlet on the body.

With reference to FIGS. 6A to 6C, a sixth embodiment of the inflatable mattress in accordance with the present invention is similar to the first embodiment however has the at least one first engaging member of the body (2) being a first zipper half (31) mounted on the sidewall (23). The at least one second engaging member is a second zipper half (32). The second zipper half (32) is mounted on the outer edge of the skirt (12) of the coverlet (1) and is engaged detachably with the first zipper half (32) through a zipper slider. The zipper slider is mounted slidably on the first and second zipper halves (31, 32) and capable of detaching from one of the first and second zipper halves (31, 32). The first and second zipper halves (31, 32) and the zipper slider cooperate to form a zipper assembly located between the body (2) and the coverlet (1).

Figure 7A:
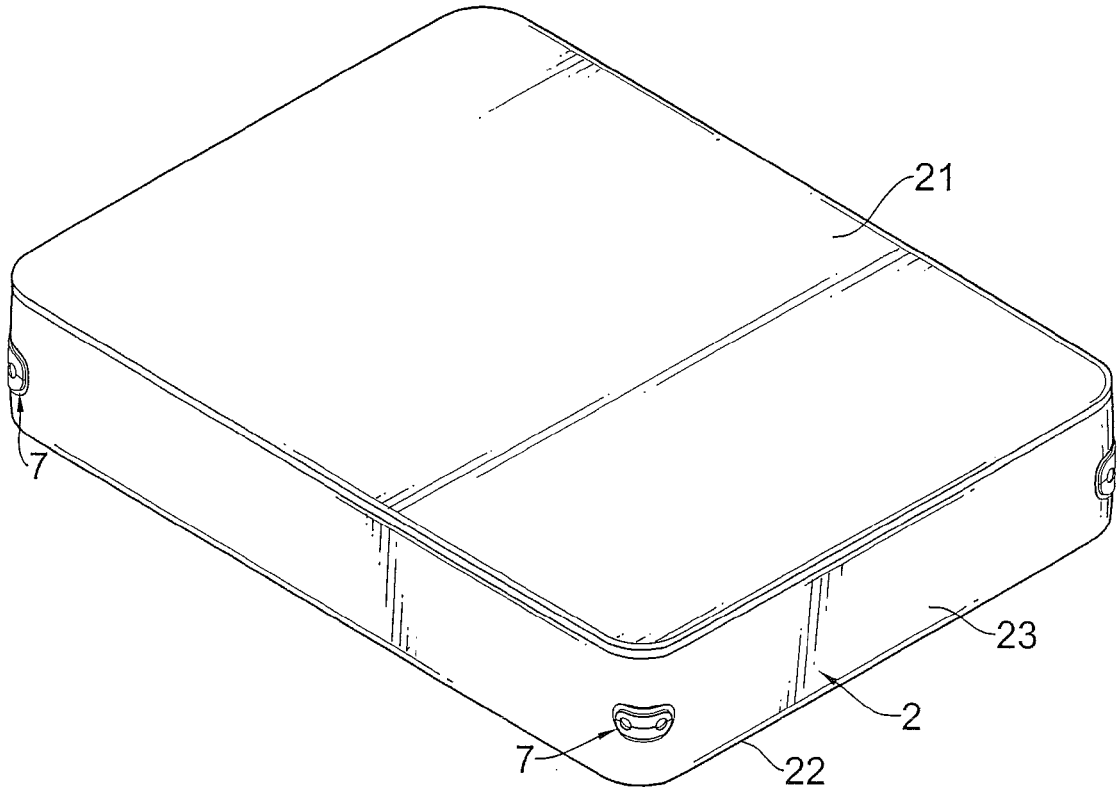
FIG. 7A is a perspective view of the body of the inflatable mattress in accordance with the present invention.
Figure 7B:
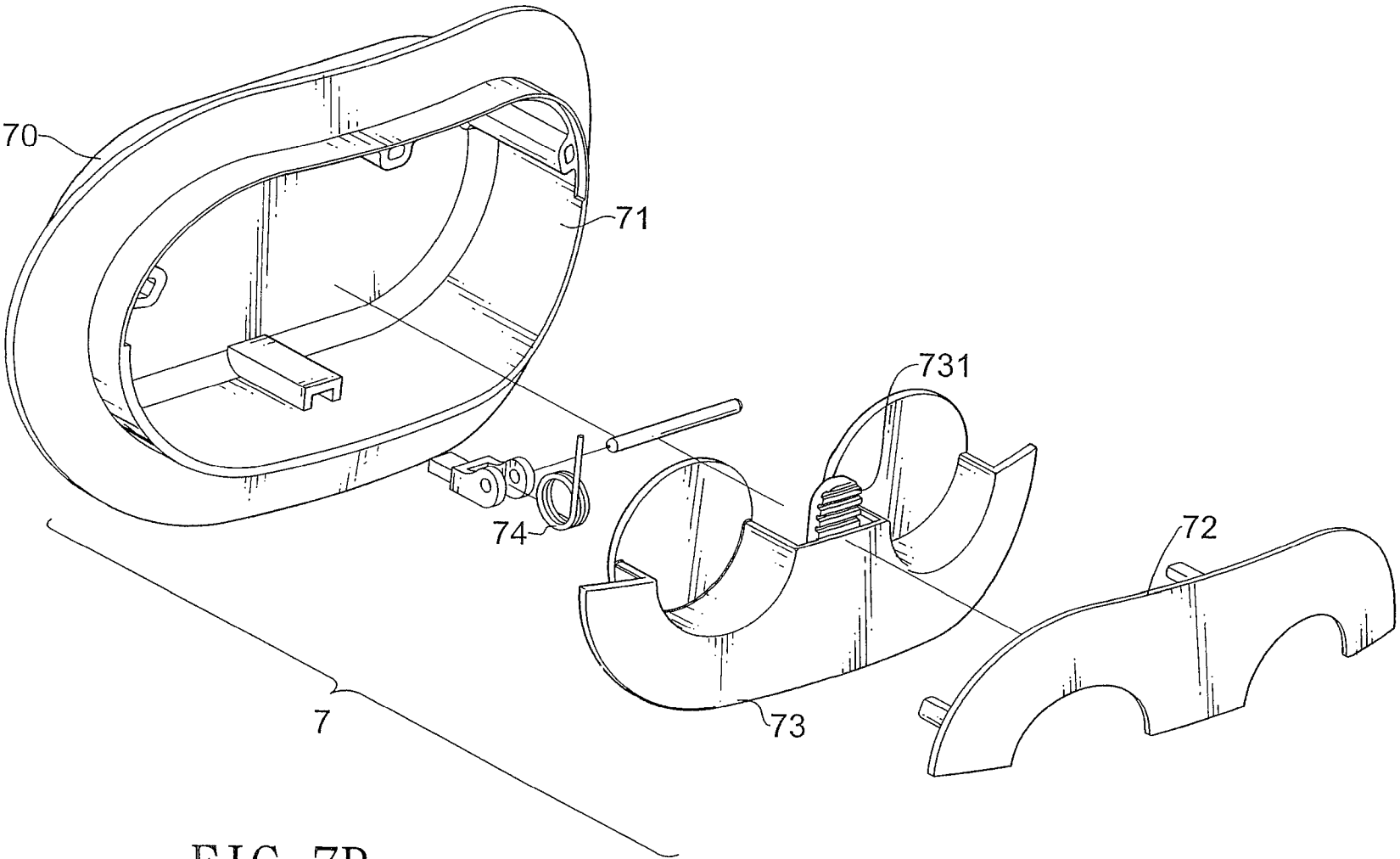
FIG. 7B is an exploded perspective view of the recess member on the body of the inflatable mattress in FIG. 7A.
Figure 7C:
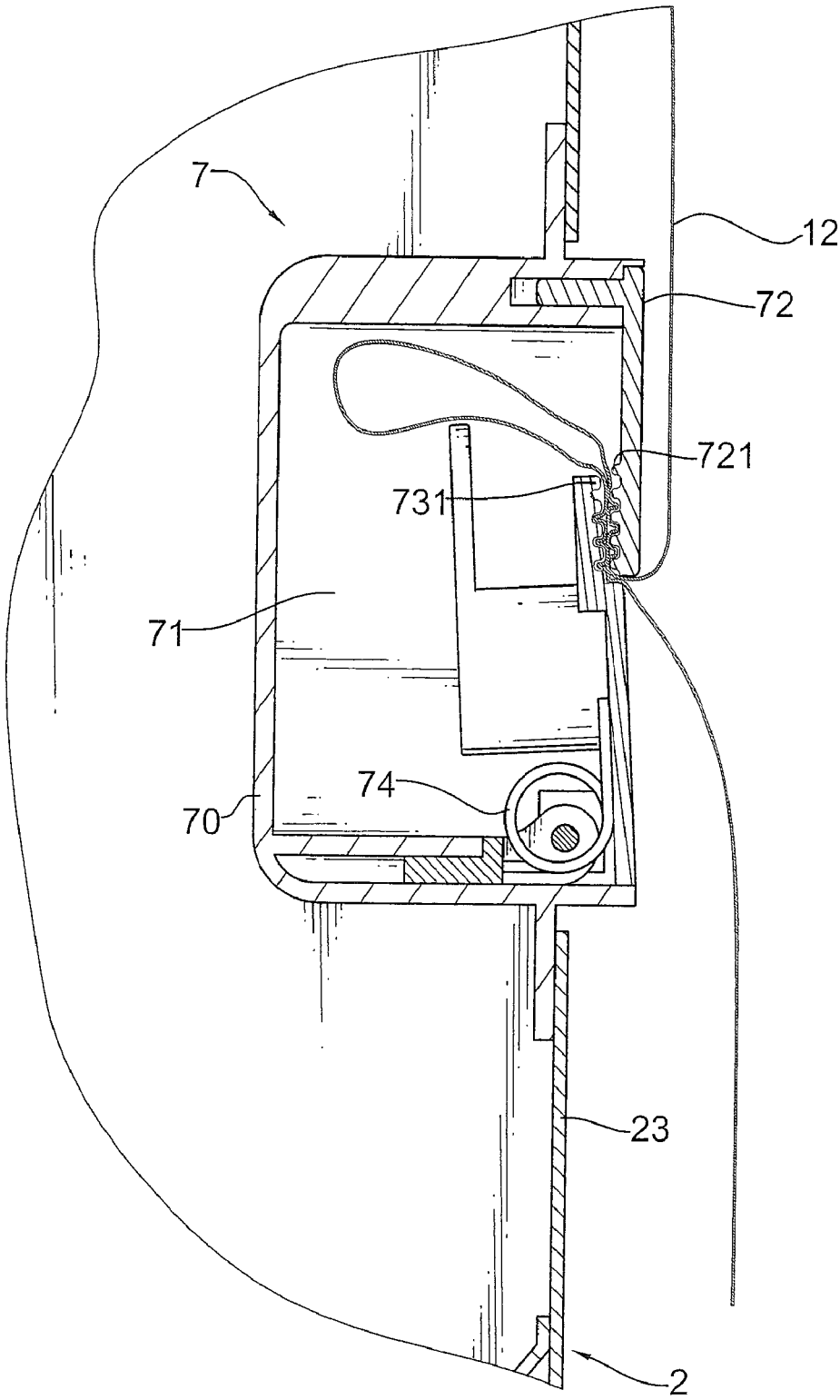
FIG. 7C is an enlarged side view in partial section of the inflatable mattress in FIG. 7A showing the skirt of the coverlet stuffed in the recess member.

With reference to FIGS. 7A-7C, a seventh embodiment of the inflatable mattress in accordance with the present invention is similar to the fourth embodiment however has the at least one first engaging member of the body (2) being four recess members (7) mounted respectively in the corners of the body (2). Each recess member (7) has a bracket (70), a stationary clipping member (72), a movable clipping member (73) and a biasing member (74). The bracket (70) is mounted in one of the corners of the body (2) and has a recess (74) defined in the bracket (70) and an outside opening communicating with the recess (71) and having an outer edge. The outer edge is annular and comprises a top edge and a bottom edge. The stationary clipping member (72) is mounted on the top edge of the outside opening and has an inside surface and multiple teeth (721). The teeth (721) are formed on the inside surface at intervals. The movable clipping member (73) is mounted pivotally on the bottom edge of the outside opening, is engaged selectively with the stationary clipping member (72) to close the recess (71) and has an outside surface and multiple teeth (731). The teeth (731) are formed on the outside surface of the movable clipping member (73) at intervals and are selectively engaged respectively with the intervals between the teeth (721) on the stationary clipping member (72). The biasing member (74) may be a torsion spring, is mounted between the bracket (70) and the movable clipping member (73) and biases the movable clipping member (73) to be engaged with the stationary clipping member (72). The at least one second engaging member of the coverlet (1) is four parts of the skirt (12) of the coverlet (1). The parts of the skirt (12) correspond respectively to and are stuffed respectively in the recess members (7). Each part of the skirt (12) is clipped and bitten by the teeth (721, 731) of the stationary and movable clipping members (72, 73) on a corresponding recess member (61).

The engagement of the at least one first engaging member on the sidewall at the distance from the top (21) of the body (2) and the at least one second engaging member on the skirt (12) of the coverlet (1) keeps the coverlet (1) mounted tightly and flatly on the body (2) without any wrinkles. Therefore, the coverlet (1) on the body (2) looks tidy and would not be shifted or detached inadvertently by persons' movement on the inflatable mattress. Also, the coverlet (1) with the top cushion (11) provides a soft and comfortable feel to persons lying on the inflatable mattress so that they would easily relax to sleep. Furthermore, the coverlet (1) is detachably mounted on the body (2) so that can be individually washed and stored. Moreover, persons carrying the inflatable mattress for travel and camping may take or leave the coverlet (1) home depending on whether they wants a fine sleep or simple and light baggage.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An inflatable mattress comprising:

a body being hollow, being inflatable and having a top;

a bottom; and a sidewall; and at least one recess member attached to and recessed in the body and each recess member having an opening; and two clipping members being mounted on the opening, and each clipping member having a clipping edge, wherein the clipping edges of the clipping members face each other;

whereby the body is adapted to be covered detachably with a coverlet by the at least one recess member holding the coverlet, at least one part of the coverlet is stuffed respectively in the at least one recess member, and a part of the coverlet is clipped by the clipping edges of the clipping members on a corresponding recess member.

2. The inflatable mattress as claimed in claim 1, wherein the at least one recess member is mounted on the sidewall at a distance from the top of the body.

3. An inflatable mattress comprising:

a body being hollow, being inflatable and having a top;

a bottom; and a sidewall; and at least one recess member attached to the sidewall of the body, and each recess member having a bracket mounted in the sidewall of the body and having a recess defined in the bracket and an opening communicating with the recess;

a stationary clipping member mounted on the opening and having multiple teeth formed on a surface of the stationary clipping member;

a movable clipping member mounted on the opening, engaged selectively with the stationary clipping member and having multiple teeth formed on a surface of the movable clipping member and selectively engaged respectively with the teeth on the stationary clipping member; and a biasing member connected to the movable clipping member and biasing the movable clipping member to be engaged with the stationary clipping member;

whereby the body is adapted to be covered detachably with a coverlet by the at least one recess member holding the coverlet, at least a part of the coverlet correspond respectively to and is stuffed respectively in the recess member, and each part of the coverlet is clipped by the teeth of the stationary and movable clipping members on a corresponding recess member.

4. The inflatable mattress as claimed in claim 3, wherein each recess member is located at a distance from the top of the body.

* * * * *